US008923484B2

(12) United States Patent
Zou et al.

(10) Patent No.: US 8,923,484 B2
(45) Date of Patent: Dec. 30, 2014

(54) MOTION CORRECTION SYSTEM AND METHOD FOR AN X-RAY TUBE

(75) Inventors: Yun Zou, Clifton Park, NY (US); Scott Stephen Zelakiewicz, Niskayuna, NY (US); Floribertus P. M. Heukensfeldt Jansen, Ballston Lake, NY (US); Jeffrey Wayne Eberhard, Albany, NY (US); Fengfeng Tao, Clifton Park, NY (US); Timothy Powers, Harvard, IL (US); Thomas Edmund Sjoberg, Waukesha, WI (US)

(73) Assignee: General Electric Company, Niskayuna, NY (US)

( * ) Notice: Subject to any disclaimer, the term of this patent is extended or adjusted under 35 U.S.C. 154(b) by 309 days.

(21) Appl. No.: 13/602,080

(22) Filed: Aug. 31, 2012

(65) Prior Publication Data

US 2014/0064456 A1 Mar. 6, 2014

(51) Int. Cl.

| | |
|---|---|
| ***H01J 35/28*** | (2006.01) |
| ***H01J 35/24*** | (2006.01) |
| ***H01J 35/14*** | (2006.01) |

(52) U.S. Cl.

CPC *H01J 35/28* (2013.01); *H01J 35/14* (2013.01)
USPC ..... 378/126; 378/121; 378/125; 378/137; 378/196

(58) Field of Classification Search

CPC ..... H01J 35/24; H01J 35/28; H01J 35/14
USPC ..... 378/121, 125, 126, 137, 196
See application file for complete search history.

(56) References Cited

U.S. PATENT DOCUMENTS

| | | | | |
|---|---|---|---|---|
| 4,158,138 | A | 6/1979 | Hellstrom | |
| 5,065,420 | A * | 11/1991 | Levene | 378/137 |
| 5,528,658 | A * | 6/1996 | Hell | 378/137 |
| 5,550,889 | A * | 8/1996 | Gard et al. | 378/113 |
| 5,579,358 | A * | 11/1996 | Lin | 378/4 |
| 5,696,808 | A * | 12/1997 | Lenz | 378/121 |
| 5,812,632 | A * | 9/1998 | Schardt et al. | 378/137 |
| 5,923,727 | A * | 7/1999 | Navab | 378/207 |
| 6,183,139 | B1 * | 2/2001 | Solomon et al. | 378/137 |
| 6,285,902 | B1 * | 9/2001 | Kienzle et al. | 600/427 |
| 6,438,207 | B1 * | 8/2002 | Chidester et al. | 378/138 |
| 6,697,664 | B2 * | 2/2004 | Kienzle, III et al. | 600/427 |
| 6,735,271 | B1 * | 5/2004 | Rand et al. | 378/4 |

(Continued)

OTHER PUBLICATIONS

Qian et al.; "High Resolution Stationary Digital Breast Tomosynthesis Using Distributed Carbon Nanotube X-Ray Source Array"; The International Journal of Medical Physics Research and Practice; vol. 4, No. 39, 2012; pp. 2090-2099.

*Primary Examiner* — David A Vanore
(74) *Attorney, Agent, or Firm* — Seema S. Katragadda

(57) ABSTRACT

A motion correction system and method for motion correction for an x-ray tube is presented. One embodiment of the motion correction system includes a sensing unit coupled to an x-ray tube to determine a distance with which an impingement location of an electron beam generated by the x-ray tube deviates from a determined location due to motion of the x-ray tube. The motion correction system further includes a control unit coupled to the sensing unit to generate a control signal corresponding to the distance with which the impingement location of the electron beam deviates. Also, the motion correction system includes a deflection unit coupled to the control unit to steer the electron beam to the determined location based on the generated control signal.

20 Claims, 6 Drawing Sheets

(56) References Cited

U.S. PATENT DOCUMENTS

| | | | | |
|---|---|---|---|---|
| 6,865,248 | B1 * | 3/2005 | Rasche et al. | 378/8 |
| 6,907,103 | B2 * | 6/2005 | Rosner et al. | 378/62 |
| 6,968,039 | B2 * | 11/2005 | Lemaitre et al. | 378/138 |
| 7,020,232 | B2 * | 3/2006 | Rand et al. | 378/4 |
| 7,142,633 | B2 | 11/2006 | Eberhard et al. | |
| 7,257,194 | B2 * | 8/2007 | Smith | 378/136 |
| 7,286,639 | B2 * | 10/2007 | Shen et al. | 378/98.8 |
| 7,286,644 | B2 * | 10/2007 | Andrews | 378/138 |
| 7,302,031 | B2 * | 11/2007 | Hjarn et al. | 378/37 |
| 7,450,690 | B2 * | 11/2008 | Block et al. | 378/136 |
| 7,648,275 | B2 * | 1/2010 | Reboni et al. | 378/207 |
| 7,949,102 | B2 * | 5/2011 | Behling | 378/124 |
| 8,270,571 | B2 * | 9/2012 | Bernhardt et al. | 378/138 |
| 8,761,344 | B2 * | 6/2014 | Reynolds et al. | 378/138 |
| 2010/0142792 | A1 | 6/2010 | Sakaguchi et al. | |
| 2010/0316275 | A1 | 12/2010 | Stolin et al. | |
| 2011/0026667 | A1 | 2/2011 | Poorter | |

* cited by examiner

MOTION CORRECTION SYSTEM AND METHOD FOR AN X-RAY TUBE

BACKGROUND

Embodiments of the present disclosure relate generally to an x-ray tube, and more particularly to a method and a system for correcting focal spot location deviation due to the motion of the x-ray tube.

Traditional x-ray imaging systems include an x-ray source and a detector array. The x-ray source generates x-rays that pass through an object under scan. These x-rays are attenuated while passing through the object and are received by the detector array. The detector array includes detector elements that produce electrical signals indicative of the attenuated x-rays received by each detector element. Further, the produced electrical signals are transmitted to a data processing system for analysis, which ultimately produces an image.

Typically, the x-ray source includes an x-ray tube that generates x-rays when an electron beam impinges on a focal spot of an anode surface. However, when the x-ray tube is in motion, such as may happen with a portable x-ray device, for example, the focal spot of the electron beam may move away from a determined location during the exposure time. As a result of this deviation of the focal spot from the determined location during exposure, motion blur will occur in the produced image of the object.

In a conventional x-ray imaging system, image processing techniques, such as motion deblurring, are employed to correct the motion blur of the produced image. However, these techniques are related to post processing of the image to correct the motion blur, and not related to correcting the deviation of the electron beam or the motion of the x-ray tube itself. Also, since the motion deblurring technique is performed after the image is produced, the time and cost for imaging the object is unnecessarily increased and the performance is in general undesirable.

Thus, there is a need for an improved method and structure for correcting the deviation of the electron beam due to motion of the x-ray tube.

BRIEF DESCRIPTION

Briefly in accordance with one aspect of the present disclosure, a motion correction system for an x-ray tube is presented. The motion correction system includes a sensing unit coupled to an x-ray tube to determine a distance with which an impingement location of an electron beam generated by the x-ray tube deviates from a determined location due to motion of the x-ray tube. The motion correction system further includes a control unit coupled to the sensing unit to generate a control signal corresponding to the distance with which the impingement location of the electron beam deviates. Also, the motion correction system includes a deflection unit coupled to the control unit to steer the electron beam to the determined location based on the generated control signal.

In accordance with a further aspect of the present disclosure, a method for correcting motion of an x-ray tube is presented. The method includes determining a distance with which an impingement location of an electron beam generated by an x-ray tube deviates from a determined location due to motion of the x-ray tube. The method further includes generating a control signal corresponding to the distance with which the impingement location of the electron beam deviates. Also, the method includes steering the electron beam to the determined location based on the generated control signal.

In accordance with another aspect of the present disclosure, an x-ray tube is presented. The x-ray tube includes a cathode unit to emit an electron beam. Further, the x-ray tube includes an anode unit having an anode surface positioned to generate x-rays when the emitted electron beam impinges on the anode surface. Additionally, the x-ray tube includes a motion correction sub-system that includes a sensing unit to determine a distance with which an impingement location of the electron beam deviates from a determined location due to motion of the x-ray tube. Also, the motion correction sub-system includes a control unit coupled to the sensing unit to generate a control signal corresponding to the distance with which the impingement location of the electron beam deviates. Further, the motion correction sub-system includes a deflection unit coupled to the control unit to steer the electron beam to the determined location based on the generated control signal.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As will be described in detail hereinafter, various embodiments of exemplary structures and methods for correcting motion of an x-ray tube are presented. By employing the methods and the various embodiments of the motion correction system described hereinafter, motion blur in a produced image is prevented, thereby substantially reducing the need for post-acquisition motion correction processing. Also, the cost and time for producing an image of an object is substantially reduced.

Figure 1:
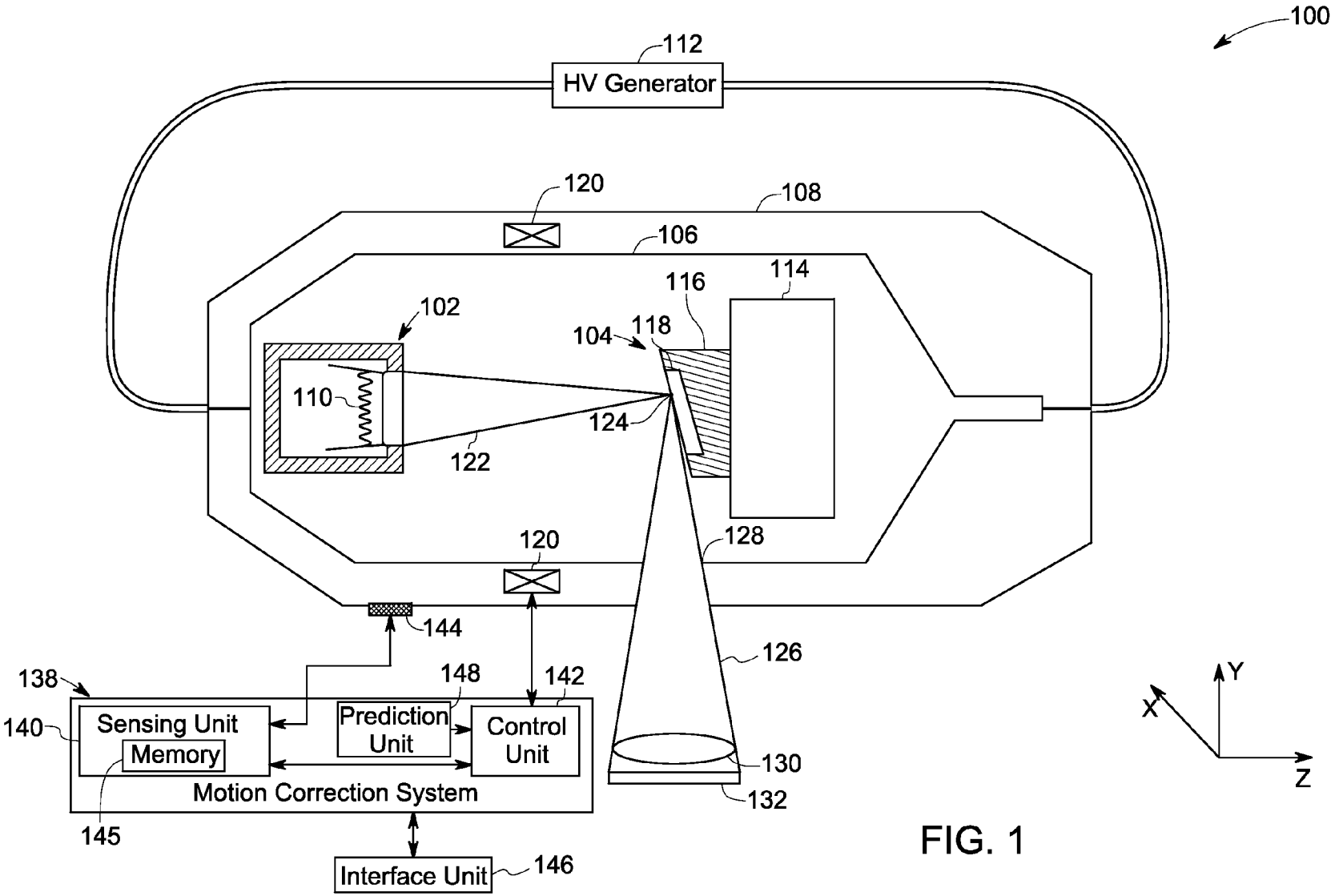
FIG. 1 is a block diagram of an x-ray tube, in accordance with aspects of the present disclosure.

Turning now to the drawings, and referring to FIG. 1, a block diagram of an x-ray tube 100, in accordance with aspects of the present disclosure, is depicted. The x-ray tube 100 is configured for emitting x-rays towards a material sample, a patient, or an object under scan. The x-ray tube 100 includes a cathode unit 102 and an anode unit 104 that are disposed within an evacuated enclosure 106. The evacuated enclosure 106 may be a vacuum chamber that is positioned within a housing 108 of the x-ray tube 100, for example.

The cathode unit 102 includes an electron source 110 for emitting an electron beam towards the anode unit 104. Particularly, an electric current is applied to the electron source 110, such as a filament, which causes the electron beam to be produced by thermionic emission. The electric current is provided from a high voltage (HV) generator 112 that is coupled between the cathode unit 102 and the anode unit 104, as depicted in FIG. 1.

Further, the anode unit 104 includes a support platform 114 and a base 116 having an anode surface 118. The base 116 is coupled to the support platform 114 and the anode surface 118 is disposed atop of the base 116. Also, the anode surface 118 is positioned in the direction of emitted electrons to receive the electrons from the cathode unit 102. Particularly, in the embodiment of FIG. 1, a copper base with an anode surface having materials with high atomic numbers ("Z" numbers), such as rhodium, palladium, and/or tungsten, is employed in the anode unit 104. The anode surface 118 may be a static anode surface or a rotating anode surface. It is to be noted that for ease of understanding of the invention, FIG. 1 is shown with the static anode surface 118.

In addition, the x-ray tube 100 includes a deflection unit 120 that creates an electrostatic field or a magnetic field between the cathode unit 102 and the anode unit 104 for deflecting or steering the electron beam prior to impinging on the anode surface 118. In one example, the deflection unit 120 may include a pair of electrostatic plates that are disposed on either side of the electron beam to steer the electron beam in a desired direction. The aspect of steering the electron beam is explained in greater detail with reference to FIGS. 2-5.

During operation, the cathode unit 102 generates an electron beam 122 that is accelerated towards the anode surface 118 of the anode unit 104 by applying a high voltage potential between the cathode unit 102 and the anode unit 104. Further, the electron beam 122 impinges upon the anode surface 118 at a determined location 124 and releases kinetic energy as electromagnetic radiation of very high frequency, i.e., x-rays. Particularly, the electron beam 122 is rapidly decelerated upon striking the anode surface 118, and in the process, the x-rays are generated therefrom. These x-rays emanate in all directions from the anode surface 118. A portion 126 of these x-rays passes through an outlet 128 of the evacuated enclosure 106 to exit the x-ray tube 100 and be utilized to interact with the object 130. Also, these x-rays 126 are attenuated while passing through the object 130 and are received by the detector 132 causing electrical signals indicative of the attenuated x-rays to be produced. Further, the produced electrical signals are transmitted to a data processing system (not shown) for analysis, which ultimately produces an image. In one embodiment, the anode surface 118 may be angled, for example about 7 to 25 degrees, towards the outlet 128 of the evacuated enclosure 106 to improve the generation of x-rays in the x-ray tube 100.

Figure 2:
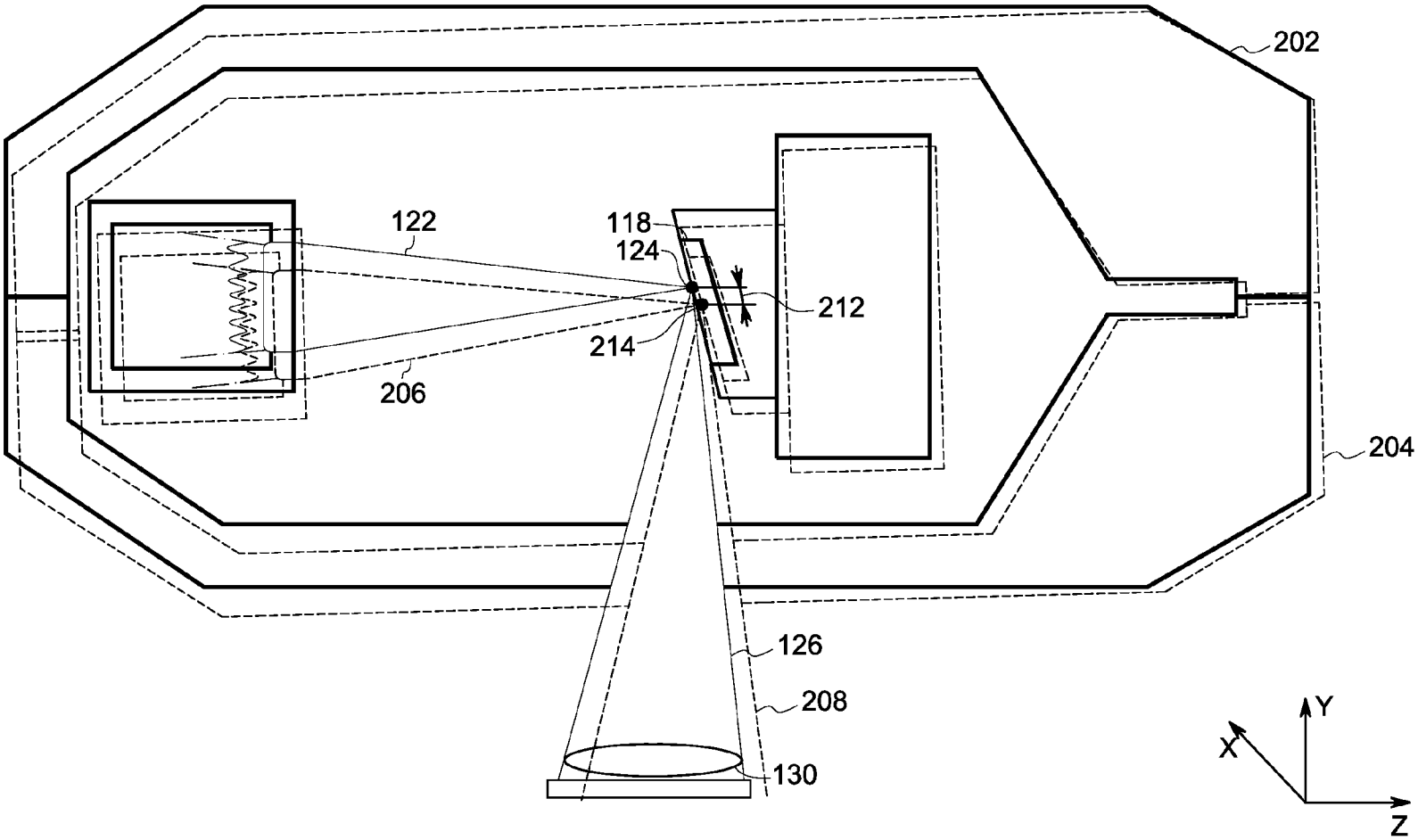
FIG. 2 is a block diagram of the x-ray tube of FIG. 1 illustrating the motion of the x-ray tube, in accordance with aspects of the present disclosure.
Figure 3:
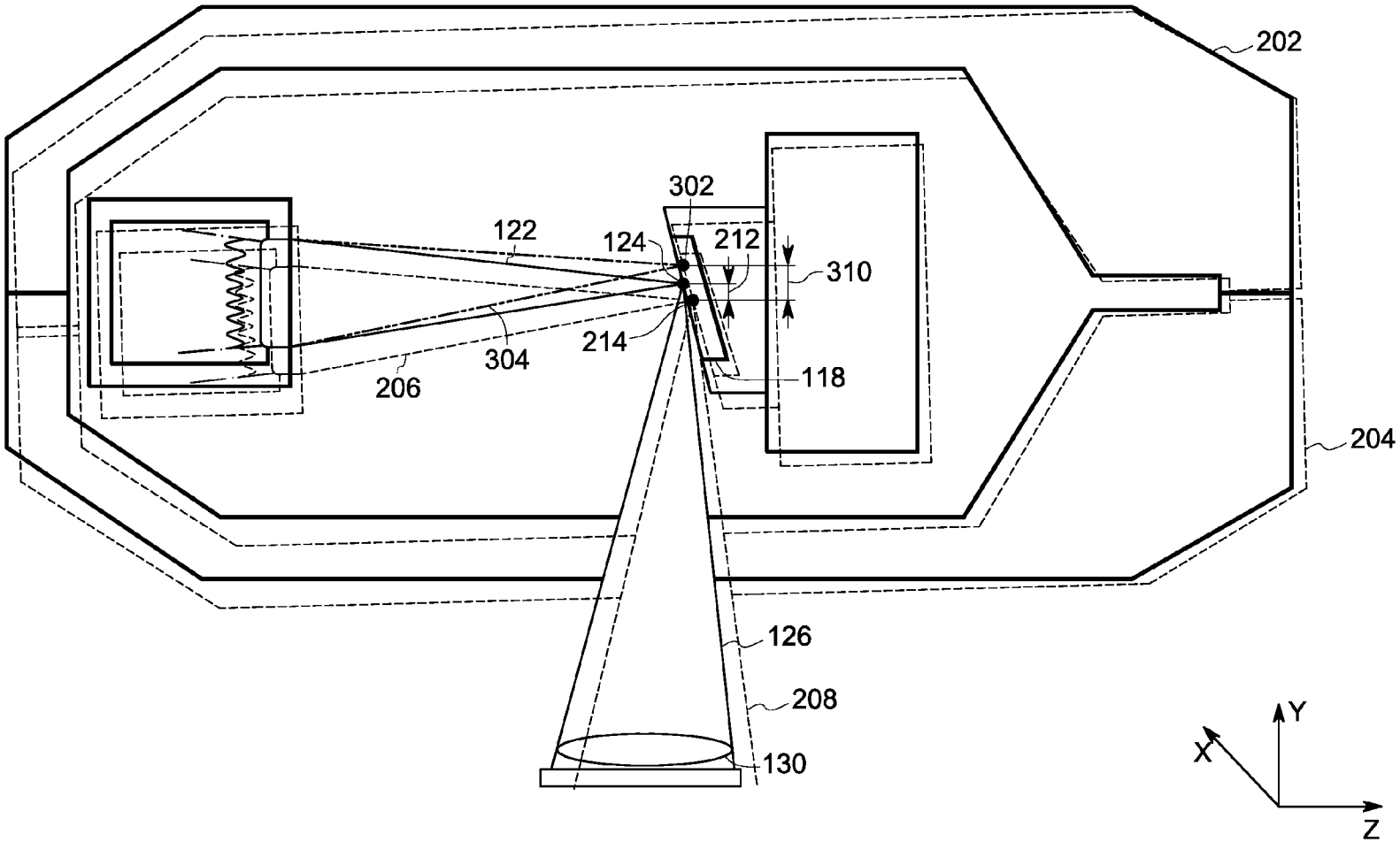
FIG. 3 is a block diagram of the x-ray tube of FIG. 1 illustrating the steering of an electron beam, in accordance with aspects of the present disclosure.

However, when the x-ray tube 100 is moved with respect to the detector 132, whether due to motion caused by a user in a handheld x-ray tube application or by a non-rigid tube positioner, an impingement location 214 (see FIG. 2) of the electron beam 122 may deviate from the determined location 124. In one example, the impingement location 214 may be representative of a focal spot of the electron beam. For ease of understanding, the movement of the x-ray tube and the deviation of the electron beam are illustrated in FIG. 2. Particularly, in FIG. 2, the x-ray tube in its initial position is represented by a reference numeral 202 and is shown in solid line. Similarly, the x-ray tube after moving from its initial position is represented by a reference numeral 204 and is shown in dotted line. Also, the deviated electron beam is represented by a reference numeral 206, and the x-rays generated from this deviated electron beam 206 is represented by a reference numeral 208. Further, the x-rays 208 generated from this deviated electron beam 206 may interact with the object 130 at undesired angles during detector acquisition and may result in motion blur in the produced image of the object 130.

To address these shortcomings or problems, a motion correction system 138 as shown in FIG. 1 is employed to correct the deviation of the electron beam 122 in the x-ray tube 100. Particularly, the deviation of the electron beam 122 due to motion of the x-ray tube 100 is corrected prior to the electron beam 122 impinging on the anode surface 118 so that a quality image can be produced without or with negligible motion blur. The motion correction system 138 may be either coupled to the x-ray tube 100 external to the housing 108 or disposed within the housing 108. In addition, the motion correction system 138 may be coupled to an interface unit 146 which allows a user or operator to activate or deactivate the motion correction system 138. For example, the user may send an input signal to the interface unit 146 to activate or deactivate functionality of the motion correction system 138.

In a presently contemplated configuration, the motion correction system 138 includes a sensing unit 140 and a control unit 142. In one embodiment, the motion correction system 138 may include the deflection unit 120 that is electrically coupled to the control unit 142. For example, an electrical cable may be used to provide a connection between the deflection unit 120 that is disposed in the housing 108 and the control unit 142. Further, the sensing unit 140 includes one or more motion sensors 144, to sense the motion of the x-ray tube 100. In one example, the motion sensors 144 may represent accelerometers that provide an electrical voltage that is proportional to the x-ray tube acceleration. Further, the sensing unit 140 may integrate these electrical voltages to determine the motion of the x-ray tube 100. In one example, three sensors may be disposed on the x-ray tube 100 to sense the motion of the x-ray tube 100 in three different directions. In addition, the sensing unit 140 includes a memory 145 to store the motion information, for example electrical voltages, received from the motion sensors 144. In the embodiment of FIG. 1, the motion sensors 144 are coupled to the housing 108 of the x-ray tube 100.

Further, the sensing unit 140 is configured to determine a distance with which the impingement location 214 of the electron beam 122 deviates from the determined location 124 due to motion of the x-ray tube 100. In FIG. 2, the impingement location 214 of the electron beam 122 is illustrated as deviating in Z-axis and Y-axis directions from the determined location 124. It is to be noted that the impingement location 214 of the electron beam 122 may deviate in any one or more of the radial directions from the determined location 124, and is not limited to the direction shown in FIG. 2.

In one embodiment, the sensing unit 140 may track the motion or movement of the x-ray tube 100 and the sensing unit 140 may use this tracked motion information for determining a distance with which the impingement location 214 of the electron beam 122 deviates from the determined location 124. For example, if the x-ray tube moves by about 1 mm along an X-axis direction and the anode surface 118 is angled by about 7 to 25 degrees away from the XY plane, as depicted in FIG. 1, the impingement location 214 of the electron beam 122 may deviate by about 1 mm in the X-axis direction. In this example, the deviated electron beam is required to be steered by about 1 mm in the opposite X-axis direction so that the electron beam impinges on the determined location 124. In another example, if the x-ray tube moves by about 1 mm along the Y-axis direction, the impingement location 214 of the electron beam 122 may deviate by a distance 212 (see FIG. 2) or about 1 mm in the Y-axis direction. In this example, since the impingement location 214 of the electron beam deviates in the Y-axis direction, the electron beam may continue to emit the x-rays at a desired angle. Thus, in this example, it is not required to steer the electron beam to the determined location 124.

Further, in yet another example, if the x-ray tube moves about 1 mm along the Z-axis direction and the anode surface 118 is offset at an angle of about 20 degrees from the Y-axis, the impingement location 214 of the electron beam 122 is moved by a distance of about 1 mm in the Z-axis direction. However, in this example, since the anode surface 118 is angled by about 20 degrees from the Y-axis, the impingement location 214 of the electron beam is required to be steered by a distance 310 (see FIG. 3) or about 1/tan (20)=2.75 mm in the Y-axis direction. Also, in this example, the electron beam is steered to a new determined location 302 (see FIG. 3) such that the x-rays are emitted at the desired angle. This electron beam steered from the impingement location 214 to the determined location 302 is represented by a reference numeral 304. In one embodiment, the sensing unit 140 uses motion algorithms for determining the distance of the impingement location 214 of the electron beam. These motion algorithms may be included as executable code/instructions in the memory 145 of the sensing unit 140.

In one embodiment, the motion correction system 138 may determine a distance with which the impingement location 214 of the electron beam deviates from the determined location 124 based on pre-stored information/data. The pre-stored information/data may include previously measured or calculated trajectories of the x-ray tube 100. Particularly, the motion correction system 138 includes a prediction unit 148 that stores the previously measured or calculated trajectories of the x-ray tube 100. Further, the prediction unit 148 may use these calculated trajectories of the x-ray tube 100 to predict the motion or deviation of the impingement location 214 of the electron beam 122. Also, the prediction unit 148 may predict the distance with which the impingement location 214 of the electron beam deviates from the determined location 124. For example, the prediction unit 148 may have a look-up table that includes the pre-stored trajectories of the x-ray tube 100 mapped to a corresponding distance of the deviated impingement location of the electron beam.

Upon determining the distance traveled by the deviated impingement location of the electron beam, the control unit 142 generates a control signal or signals corresponding to the distance with which the electron beam is required to be steered to the determined location. It is to be noted that the control unit 142 may receive the distance information of the deviated impingement location of the electron beam from the sensing unit 140 and/or the prediction unit 148. The control signal may include a voltage signal or a current signal, which is provided to the deflection unit 120 to cause the deflection unit 120 to steer the electron beam from the impingement location 214 to the determined location 124 or 302. The aspect of steering the electron beam 122 and correcting the motion of the x-ray tube 100 is explained in greater detail with reference to FIG. 4.

Thus, by employing the motion correction system 138, the deviated impingement location of the electron beam 206 may be steered to the determined location. Also, since the motion correction system 138 steers the electron beam 206 to the determined location, motion blur in the produced image may be eliminated, which in turn improves the quality of the produced image of the object 130 and reduces the need for motion correction through post-acquisition processing.

Figure 4:
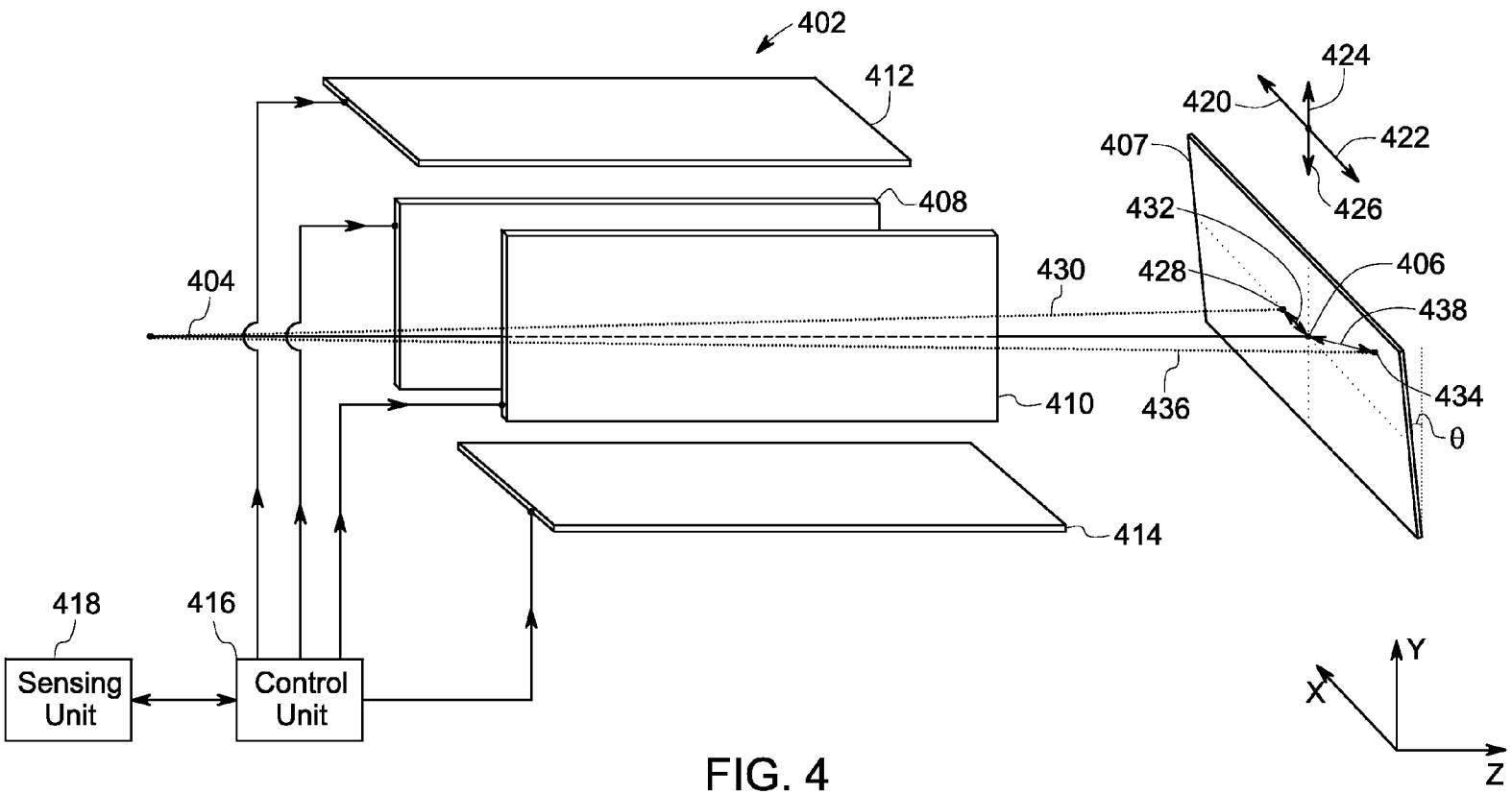
FIG. 4 is a diagrammatical representation of an electrostatic deflection unit, in accordance with aspects of the present disclosure.

Referring to FIG. 4, a diagrammatical representation 400 of an electrostatic deflection unit, in accordance with one embodiment of the present disclosure, is depicted. Reference numeral 402 may be representative of the deflection unit 120 of FIG. 1. The deflection unit 402 may include two pairs of electrostatic plates that create an electrostatic field across an electron beam 404 for steering the electron beam 404 to a determined location 406 on an anode surface 407. The electron beam 404 may be representative of the electron beam 122 of FIG. 1, and the determined location 406 may be representative of the determined location 124 of FIG. 1. It is to be noted that the deflection unit 402 may include electrostatic plates/electrodes of any dimension and shape, and is not limited to the dimension and shape shown in FIG. 4.

In the embodiment of FIG. 4, electrostatic plates 408, 410, 412, 414 are positioned parallel to each other and proximate to the electron beam 404. Particularly, a first electrostatic plate 408 is positioned on a left side of the electron beam 404, while a second electrostatic plate 410 is positioned on a right side of the electron beam 404. In a similar manner, a third electrostatic plate 412 is positioned on a top side of the electron beam 404, while a fourth electrostatic plate 414 is positioned on a bottom side of the electron beam 404, as depicted in FIG. 4. It is to be noted that the terms left, right, top, bottom etc. are relative terms and are used only for illustrative purpose. Also, the terms first, second, third, fourth etc. are used to differentiate the components/directions, and are not limited with their order.

In accordance with aspects of the present disclosure, the deflection unit 402 is electrically coupled to a control unit 416. The control unit 416 may be representative of the control unit 142 of FIG. 1. The control unit 416 is configured to send a voltage signal or a current signal to the deflection unit 402 to steer the electron beam to the determined location 406 after having deviated due to movement of the x-ray tube 100. Particularly, a sensing unit 418 may track the motion or movement of the x-ray tube 100 including motion information such as a direction and a distance with which the x-ray tube moved from its initial position. The sensing unit 418 may be representative of the sensing unit 140 of FIG. 1.

Further, the sensing unit 418 may use this motion information for determining a distance with which an impingement location of the electron beam 404 deviates from the determined location 406. Since the electron beam deviates along with the deviation or movement of the x-ray tube, the distance and the direction of the deviated impingement location of the electron beam will be correlated to the distance and the direction of the movement of the x-ray tube. Particularly, the sensing unit 418 uses the motion information of the x-ray tube to compute a distance that is required to steer the deviated electron beam to the determined location 406.

With continued reference to FIG. 4, if the x-ray tube moves by about 1 mm along an X-axis direction for example, the impingement location 428 of the electron beam 404 may deviate by a distance 432 or about 1 mm in the X-axis direction. This deviated electron beam is represented by a reference numeral 430. In response, the control unit 416 may generate a control signal to move the electron beam by 1 mm in the opposite X-axis direction to return the impingement location 428 of the electron beam to its initial location or determined location 406. In another example, if the impingement location 434 of the x-ray tube moves by about 1 mm along the X-axis direction and 1 mm along a Y-axis direction, the impingement location 434 of the electron beam 404 may deviate by a distance 438 or about 1 mm in the X-axis direction and about 1 mm in the Y-axis direction. This deviated electron beam may be represented by a reference numeral 436. It is to be noted that the reference numeral 434 represents the impingement location of the deviated electron beam 436 and the reference numeral 428 represents the impingement location of the deviated electron beam 430. In response, the control unit 416 may generate a control signal to move the impingement location 434 of the electron beam by 1 mm in the opposite X-axis direction with movement in the Y-axis direction not being needed. In yet another example, if the x-ray tube moves by about 1 mm along the Z-axis direction and an anode surface 407 is at an angle of about 20 degrees from the Y-axis, the impingement location of the electron beam 404 may be moved by a distance of about 1 mm in the Z-axis direction. The angle of the anode surface 407 is represented by 'θ' in FIG. 4. In response, the control unit 416 may generate a control signal to steer the electron beam by about 1/tan (20)=2.75 mm in the Y-axis direction to move the impingement location of the electron beam to a new determined location (not shown in FIG. 4) such that the x-rays pass through the object 130 and are received at the detector 132 at substantially the same angles as before the x-ray tube movement.

Furthermore, the determined distance by which the deviated impingement location of the electron beam is to be steered to the determined location or a representation of the distance is provided to the control unit 416 for generating a corresponding voltage or current signal. It is to be noted that for ease of understanding the invention, the example of the deviated impingement location of the electron beam 430 is considered in the following description. In this example, the control unit 416 determines that the impingement location 428 of the electron beam 430 deviates by the distance 432 or about 1 mm from the determined location 406 in a first direction 420. Further, the control unit 416 generates a voltage or current signal that corresponds to the determined distance 432 or about 1 mm. Thereafter, the voltage or current signal is provided to the deflection unit 402 for steering the electron beam 430 so that the impingement location 428 of the electron beam 430 is moved to the determined location 406. Particularly, the voltage or current signal is provided to the electrostatic plates 408, 410 to steer the electron beam 430 in a second direction 422 that is opposite to the first direction 420 by a distance 432 or about 1 mm.

In accordance with aspects of the present disclosure, the voltage signal or the current signal applied to one electrostatic plate, for example the electrostatic plate 408, may include either a positive amplitude value or a negative amplitude value with respect to the opposite electrostatic plate, for example the electrostatic plate 410, depending upon a direction of the deviated electron beam. For example, the voltage signal or the current signal applied to the electrostatic plate 408 may have a positive amplitude value with respect to the opposite electrostatic plate 410 to steer the electron beam 404 in the first direction 420. Similarly, the voltage signal or the current signal applied to the electrostatic plate 408 may have a negative amplitude value with respect to the opposite electrostatic plate 410 to steer the electron beam 404 in the second direction 422. Thus, by providing this voltage or current signal to the electrostatic plates 408, 410, the electron beam is steered in the X-axis, as depicted in FIG. 4.

In a similar manner, the voltage signal or the current signal applied to the electrostatic plate 412 may have a positive amplitude value with respect to the opposite electrostatic plate 414 to steer the electron beam 404 in a third direction 424. Also, the voltage signal or the current signal applied to the electrostatic plate 412 may have a negative amplitude value with respect to the opposite electrostatic plate 414 to steer the electron beam 404 in a fourth direction 426. Thus, by providing this voltage or current signal to the electrostatic plates 412, 414, the electron beam is steered in the Y-axis, as depicted in FIG. 4.

Thus, by providing the voltage or current signals to their respective electrostatic plates, a corresponding electrostatic field is created between the plates 408, 410, 412, 414 to steer the electron beam to the determined location 406. Since the electron beam is steered to impinge on the determined location 406, the x-rays generated from this electron beam may scan the object at desired angles, which in-turn improves the quality of an image of the object.

Figure 5:
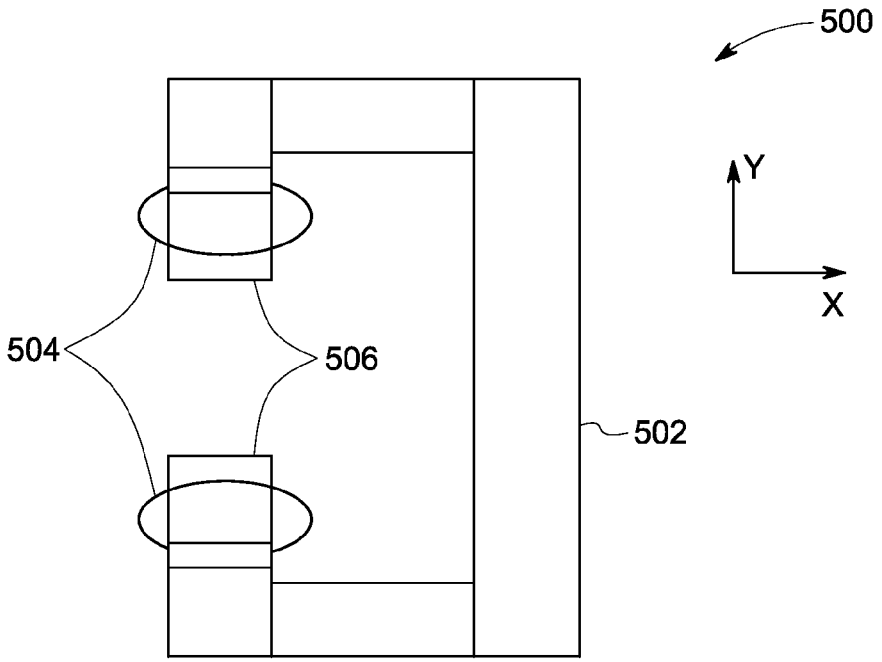
FIG. 5 is a diagrammatical representation of a magnetic deflection unit, in accordance with one embodiment of the present disclosure.

Turning now to FIG. 5, a diagrammatical representation of a magnetic deflection unit 500, in accordance with one embodiment of the present disclosure, is depicted. The deflection unit 500 may be representative of the deflection unit 120 of FIG. 1. The deflection unit 500 includes a C-arm magnet 502 with coils 504 wound at the end of each arm 506, as depicted in FIG. 5. Further, the coils 504 may generate a magnetic field between the arms 506 to steer an electron beam along the X-axis. Particularly, a control signal is provided to the coils 504 to generate the magnetic field between the arms 506. Further, when the electron beam travels between the arms 506, the generated magnetic field may create a magnetic force on the electron beam to steer the electron beam along the X-axis.

Figure 6:
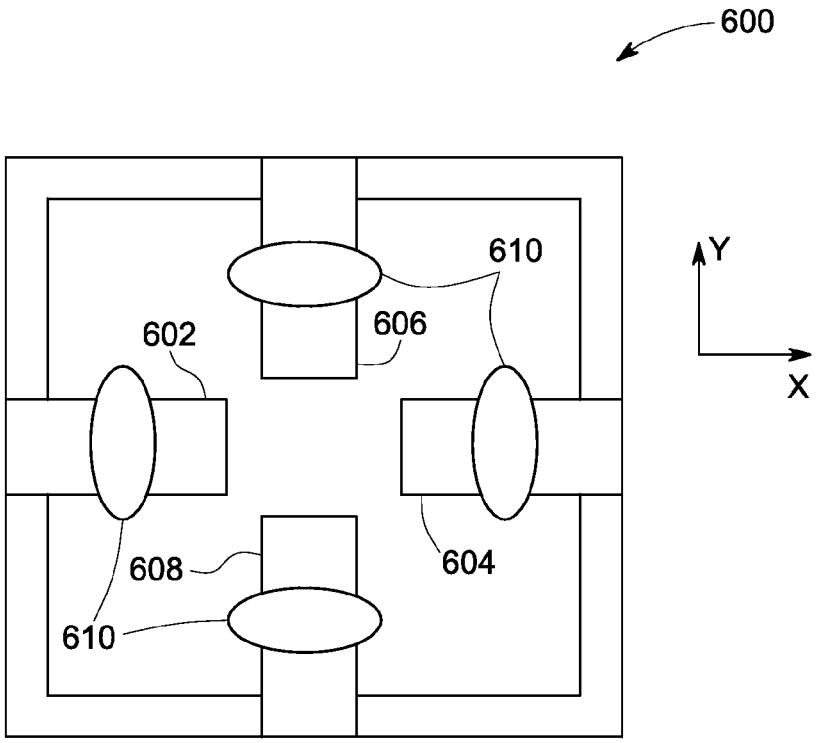
FIG. 6 is a diagrammatical representation of a magnetic deflection unit, in accordance with another embodiment of the present disclosure.

FIG. 6 is a diagrammatical representation of a magnetic deflection unit 600, in accordance with another embodiment of the present disclosure. The deflection unit 600 may be representative of the deflection unit 120 of FIG. 1. The deflection unit 600 includes a magnetic sub-unit to steer the electron beam to a determined location based on a control signal. Particularly, the deflection unit 600 includes a magnetic structure with four arms positioned on the X-Y axis, as depicted in FIG. 6. For example, a first arm 602 and a second arm 604 are positioned opposite to each other along the X-axis. Similarly, a third arm 606 and a fourth arm 608 are positioned opposite to each other along the Y-axis. Further, coils 610 are wound at the end of each arm as depicted in FIG. 6. Since the coils 610 are positioned on the X-axis and Y-axis, the magnetic field created between the arms based on the control signal may help in deflecting the electron beam in any of the radial directions from the determined location.

Figure 7:
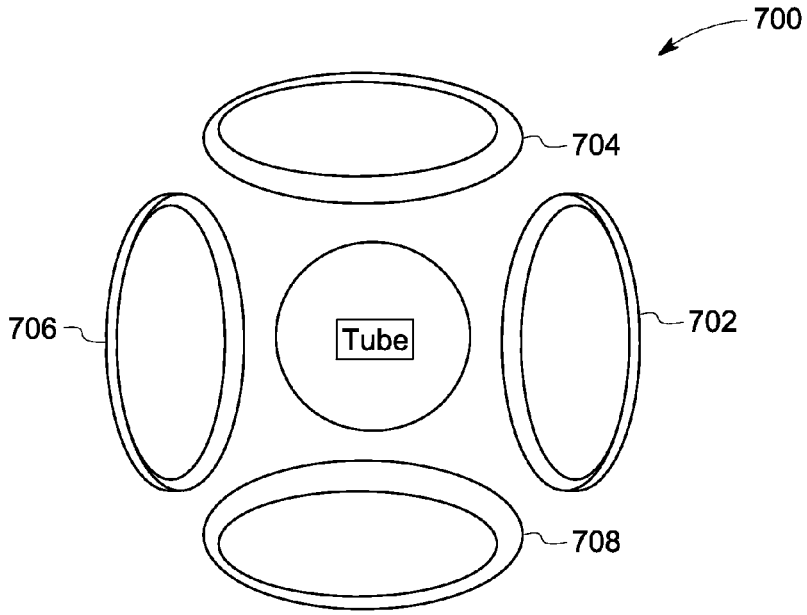
FIG. 7 is a diagrammatical representation of a magnetic deflection unit, in accordance with yet another embodiment of the present disclosure.

Referring to FIG. 7, a diagrammatical representation of a magnetic deflection unit 700, in accordance with yet another embodiment of the present disclosure, is depicted. The deflection unit 700 may be representative of the deflection unit 120 of FIG. 1. The deflection unit 700 includes two pairs of coils (702, 706) and (704, 708) where each pair is positioned orthogonal to the other pair as depicted in FIG. 7. In one embodiment, these coils 702, 704, 706, 708 may be Helmholtz coils with magnets that are configured to steer the electron beam to the determined location.

Figure 8:
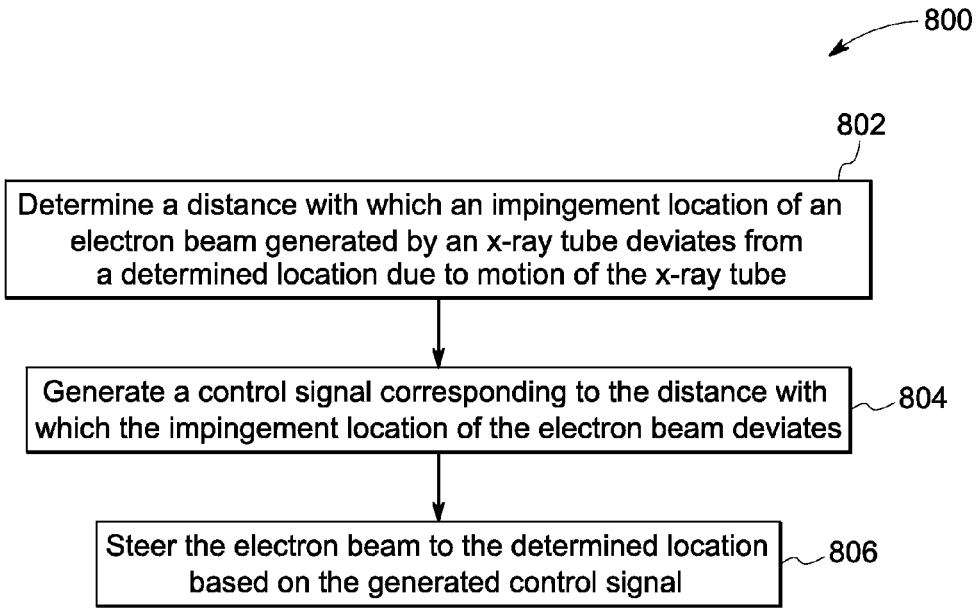
FIG. 8 is a flow chart illustrating a method for correcting motion of the x-ray tube, in accordance with aspects of the present disclosure.

Turning now to FIG. 8, a flowchart 800 illustrating a method for motion correction of an x-ray tube, in accordance with aspects of the present disclosure, is depicted. For ease of understanding of the present disclosure, the method is described with reference to the components of FIGS. 1-4. The method begins at step 802, where a distance with which an impingement location 214 of an electron beam 122 generated by an x-ray tube 100 deviates from a determined location 124 due to motion of the x-ray tube 100 is determined. To that end, a sensing unit 140 is used for determining the distance of the deviated impingement location of the electron beam from the determined location 124. Particularly, the sensing unit 140 tracks the motion of the x-ray tube by using the motion sensors 144. Further, the sensing unit 140 determines the distance of the deviated impingement location of the electron beam based on the tracked motion information of the x-ray tube.

Subsequently, at step 804, a control signal is generated corresponding to the distance with which the impingement location of the electron beam deviates. To that end, a control unit 142 is used to generate the control signal that includes either a voltage signal or a current signal based on the computed distance of the deviated impingement location of the electron beam. The voltage signal or the current signal includes one of a positive amplitude value and a negative amplitude value corresponding to one of the radial directions of the deviated impingement location of the electron beam from the determined location 124.

In addition, at step 806, the electron beam is steered to the determined location 124 based on the generated control signal. To that end, the deflection unit 120 is used for steering the electron beam. Particularly, the deflection unit 120 receives the control signal from the control unit 142. Further, based on the positive amplitude value or the negative amplitude value of the control signal, the deflection unit 120 steers the electron beam in a corresponding direction to impinge on the determined location 124. For example, if the control signal includes a positive amplitude value, the electron beam is deviated in a first direction 420, whereas if the control signal includes a negative amplitude value, the electron beam is deviated in a second direction 422. Thus, by employing the motion correction system and method, the deviation of the electron beam is corrected and the motion blur in the produced image may be substantially reduced.

The various embodiments of the motion correction system and method aid in correcting the deviation of electron beam due to motion of the x-ray tube. Also, as the deviation of the electron beam is corrected to impinge on the determined location, the motion blur in the produced image may be substantially reduced and also, the quality of the produced image is significantly improved. In addition, since no post processing is required to deblur the image, the cost and time for producing the image of an object is substantially reduced.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A motion correction system, comprising:

a sensing unit coupled to an x-ray tube to determine a distance with which an impingement location of an electron beam generated by the x-ray tube deviates from a determined location due to motion of the x-ray tube;

a control unit coupled to the sensing unit to generate a control signal corresponding to the distance with which the impingement location of the electron beam deviates; and a deflection unit coupled to the control unit to steer the electron beam to the determined location based on the generated control signal.

2. The motion correction system of claim 1, wherein the sensing unit comprises at least one motion sensor coupled to the x-ray tube to sense the motion of the x-ray tube.

3. The motion correction system of claim 1, wherein the sensing unit determines a direction of the deviated impingement location of the electron beam based on the motion of the x-ray tube.

4. The motion correction system of claim 1, wherein the control unit generates the control signal comprising at least one of a voltage signal and a current signal based on the determined distance.

5. The motion correction system of claim 1, wherein the deflection unit comprises at least two electrostatic plates to deflect the electron beam proportional to the generated control signal.

6. The motion correction system of claim 1, wherein the deflection unit comprises a magnetic sub-unit to steer the electron beam to the determined location based on the generated control signal.

7. The motion correction system of claim 1, further comprising a prediction unit coupled to the control unit to estimate the distance with which the impingement location of the electron beam deviates from the determined location based on pre-stored trajectories of the x-ray tube.

8. A method, comprising:

determining a distance with which an impingement location of an electron beam generated by an x-ray tube deviates from a determined location due to motion of the x-ray tube;

generating a control signal corresponding to the distance with which the impingement location of the electron beam deviates; and steering the electron beam to the determined location based on the generated control signal.

9. The method of claim 8, further comprising estimating the distance with which the impingement location of the electron beam deviates from the determined location based on pre-stored trajectories of the x-ray tube.

10. The method of claim 8, wherein generating the control signal comprises generating at least one of a voltage signal and a current signal based on the determined distance.

11. The method of claim 10, wherein the at least one of the voltage signal and the current signal comprises one of a positive amplitude value and a negative amplitude value corresponding to one of the radial directions of the deviated impingement location of the electron beam.

12. The method of claim 8, wherein steering the electron beam to the determined location comprises creating an electrostatic field proportional to the generated control signal to deflect the electron beam to the determined location.

13. The method of claim 8, wherein steering the electron beam to the determined location comprises creating a magnetic field proportional to the generated control signal to deflect the electron beam to the determined location.

14. An x-ray tube, comprising:

a cathode unit to emit an electron beam;

an anode unit having an anode surface positioned to generate x-rays when the emitted electron beam impinges on the anode surface;

a motion correction sub-system comprising:

a sensing unit to determine a distance with which an impingement location of the electron beam deviates from a determined location due to motion of the x-ray tube;

a control unit coupled to the sensing unit to generate a control signal corresponding to the distance with which the impingement location of the electron beam deviates; and a deflection unit coupled to the control unit to steer the electron beam to the determined location based on the generated control signal.

15. The x-ray tube of claim 14 further comprising an interface unit to activate or deactivate the motion correction subsystem based on an input signal.

16. The x-ray tube of claim 14, wherein the sensing unit comprises at least one motion sensor coupled to the x-ray tube to sense the motion of the x-ray tube.

17. The x-ray tube of claim 14, wherein the sensing unit determines a direction of the deviated impingement location based on the motion of the x-ray tube.

18. The x-ray tube of claim 14, wherein the control unit generates the control signal comprising at least one of a voltage signal and a current signal based on the determined distance.

19. The x-ray tube of claim 14, wherein the deflection unit comprises at least two electrostatic plates to deflect the electron beam proportional to the generated control signal.

20. The x-ray tube of claim 14, wherein the deflection unit comprises a magnetic sub-unit to steer the electron beam to the determined location based on the generated control signal.

* * * * *